US007322409B2

(12) United States Patent
Wittle et al.

(10) Patent No.: US 7,322,409 B2
(45) Date of Patent: Jan. 29, 2008

(54) METHOD AND SYSTEM FOR PRODUCING METHANE GAS FROM METHANE HYDRATE FORMATIONS

(75) Inventors: J. Kenneth Wittle, Chester Springs, PA (US); Christy W. Bell, Berwyn, PA (US)

(73) Assignee: Electro-Petroleum, Inc., Wayne, PA (US)

( * ) Notice: Subject to any disclaimer, the term of this patent is extended or adjusted under 35 U.S.C. 154(b) by 212 days.

(21) Appl. No.: 11/047,515

(22) Filed: Jan. 31, 2005

(65) Prior Publication Data

US 2005/0161217 A1 Jul. 28, 2005

Related U.S. Application Data

(63) Continuation-in-part of application No. 10/279,431, filed on Oct. 24, 2002, now Pat. No. 6,877,556.

(60) Provisional application No. 60/335,701, filed on Oct. 26, 2001.

(51) Int. Cl.
*E21B 43/24* (2006.01)

(52) U.S. Cl. ..... 166/248; 166/272.1; 166/65.1

(58) Field of Classification Search ..... 166/248, 166/272, 302, 65.1, 65.11
See application file for complete search history.

(56) References Cited

U.S. PATENT DOCUMENTS 2,799,641 A 7/1957 Bell
3,724,543 A 4/1973 Bell et al.
3,782,465 A 1/1974 Bell et al.
3,915,819 A 10/1975 Bell et al.
3,920,072 A * 11/1975 Kern ..... 166/248
3,948,319 A 4/1976 Pritchett
3,980,053 A 9/1976 Horvath
4,067,390 A * 1/1978 Camacho et al. ..... 166/302
4,199,025 A 4/1980 Carpenter
4,206,024 A 6/1980 Carpenter et al.

(Continued)

OTHER PUBLICATIONS

Connors, Thomas F., et al., "Determination of Standard Potentials and Electron-Transfer Rates for Halobiphenyls from Electrocatalytic Data", Analytical Chemistry, Jan. 1985, vol. 57, No. 1, pp. 170-174.

(Continued)

*Primary Examiner*—William P Neuder
(74) *Attorney, Agent, or Firm*—Patrick J. Hagan, Esq.; Dann, Dorfman, Herrell and Skillman

(57) ABSTRACT

A system for producing gas from a gas hydrate formation includes a first electrode and a second electrode. The first electrode is disposed in proximity of a first region of the formation, and the second electrode is disposed within a second region of the formation. The second electrode is separated from the first electrode by an electro-conductive path through the formation. An extraction well extends within the formation and intersects the electro-conductive path. The well comprises one or more perforations in fluid communication with the formation. A voltage source is connected to the electrodes and operates to produce a voltage difference across the electrodes. A method for extracting gases from a gas hydrate formation includes the step of establishing a voltage difference across two or more electrodes in a hydrate formation to thermally react with the hydrate formation and release gas from the formation.

14 Claims, 3 Drawing Sheets

U.S. PATENT DOCUMENTS

| | | | | |
|---|---|---|---|---|
| 4,382,469 | A | 5/1983 | Bell et al. | |
| 4,473,114 | A | 9/1984 | Bell et al. | |
| 4,495,990 | A | 1/1985 | Titus et al. | |
| 5,012,868 | A | 5/1991 | Bridges | |
| 5,074,986 | A | 12/1991 | Probstein et al. | |
| 5,595,644 | A | 1/1997 | Doring et al. | |
| 5,621,845 | A * | 4/1997 | Bridges et al. | 392/303 |
| 5,738,778 | A | 4/1998 | Doring | |
| 6,877,556 | B2 * | 4/2005 | Wittle et al. | 166/248 |
| 2004/0149438 | A1 * | 8/2004 | Shaw et al. | 166/272.3 |

OTHER PUBLICATIONS

Liu, Zhijie, et al., "Electrolytic Reduction of Low Molecular Weight Chlorinated Aliphatic Compounds: Structural and Thermodynamic Effects on Process Kinetics", Environmental Science and Technology, Jan. 2000, vol. 34 No. 5, pp. 804-811.

Shirai, Kimihiro, et al., "Electrochemical Oxidation of 2,2,2-trifluoroethanol to trifluoroacetaldehyde 2,2,2-trifluoroethyl hemiacetal", Tetrahedron Letters, 41, 2000, Elsevier Science Ltd., pp. 5873-5876.

Sonoyama, Noriyuki, et al., "Electrochemical Continuous Decomposition of Chloroform and Other Volatile Chlorinated Hydrocarbons in Water Using a Column Type Metal Impregnated Carbon Fiber Electrode", Environmental Science and Technology, Aug. 1999, vol. 33, No. 19, pp. 3438-3442.

* cited by examiner

METHOD AND SYSTEM FOR PRODUCING METHANE GAS FROM METHANE HYDRATE FORMATIONS

CROSS-REFERENCE TO RELATED APPLICATIONS

This is a continuation-in part of U.S. patent application Ser. No. 10/279,431, filed Oct. 24, 2002, now U.S. Pat. No. 6,877,556 which claims the benefit of U.S. Provisional Application No. 60/335,701, filed Oct. 26, 2001, the entire disclosures of which are incorporated by reference herein.

FIELD OF THE INVENTION

The present invention relates generally to the production of natural gas, and more particularly to a method and system for producing natural gas from gas reserves with the aid of electric current.

BACKGROUND

The U.S. Department of Energy estimates that the ocean floor and arctic permafrost regions contain several trillion cubic feet of methane gas (also referred to as natural gas) in the form of methane hydrates. Methane hydrates are clathrate compounds which are inclusion complexes formed at high pressures and low temperatures, existing as solid crystalline structures. In these structures, methane gas molecules are surrounded or included by a cage of water molecules. Methane hydrates are typically found on the ocean floor in sediments which are stable at depths of approximately 300 meters.

There is increasing interest in the development of methods to extract methane gas from formations containing methane hydrates. The production of methane gas is viewed as one means for lessening global dependency on oil and other fuels containing large amounts of carbon. Efforts to increase methane gas production are also motivated by an expanding natural gas infrastructure and growing interest in natural gas from public utility companies. At least one extraction technique, solvent injection, has been proposed and tested to extract methane gas from methane hydrates. Although solvent injection has shown promise, the technique is difficult to apply uniformly through a formation, and may not be suitable for deep formations. As a result, currently proposed techniques for extracting methane gas from methane hydrate formations leave much to be desired.

SUMMARY OF THE INVENTION

In a first aspect of the invention, a system for extracting gases from a gas hydrate formation includes a first electrode and a second electrode. The first electrode is disposed in proximity to a first region of the formation, and the second electrode is disposed within a second region of the formation. The second electrode is separated from the first electrode by an electro-conductive path through the formation. An extraction well extends within the formation in proximity to the electro-conductive path. The well comprises one or more perforations in fluid communication with the formation. A voltage source is connected to the first and second electrodes and operates to produce a voltage difference across the first and second electrodes.

In one embodiment of the invention, a system includes a first electrode in proximity to a first region of a formation containing methane hydrates on the ocean floor. A second electrode is disposed within a second region of the formation. The second electrode is separated from the first electrode by an electro-conductive path through the methane hydrate formation. An extraction well extends within the formation in proximity to the electro-conductive path. The well comprises one or more perforations in fluid communication with the formation. A voltage source is connected to the first and second electrodes and operates to produce a voltage difference across the first and second electrodes. Upon operation of the voltage source, resistance in the formation causes the voltage difference between the electrodes to generate heat energy which is sufficient to thermally react with the methane hydrates thereby releasing methane gas from the formation. The methane gas is formed at elevated pressure, which drives the gas into the extraction well. The methane gas may be recovered and stored on a barge or other ocean vessel. Once on the barge, the gas may be used to fuel an electric generator. Alternatively, the methane gas may be conveyed by undersea piping to a facility on land e.g. for distribution.

In a second aspect of the invention, a method for extracting gas from a formation containing gas hydrates includes the step of placing two or more electrodes in proximity to the formation and drilling an extraction well into the formation. The extraction well has one or more perforations to connect the interior of the well with the formation. A source of voltage is connected to the electrodes, and a voltage difference is established across the electrodes to produce an electrical current through the formation. The current through the formation is adjusted to thermally react with the gas hydrates in the formation and release gases from the gas hydrates. Gases released from the gas hydrates are drawn into the extraction well.

DESCRIPTION OF THE DRAWINGS

The foregoing summary as well as the following description will be better understood when read in conjunction with the figures in which.

DETAILED DESCRIPTION OF THE PREFERRED EMBODIMENT

Figure 1:
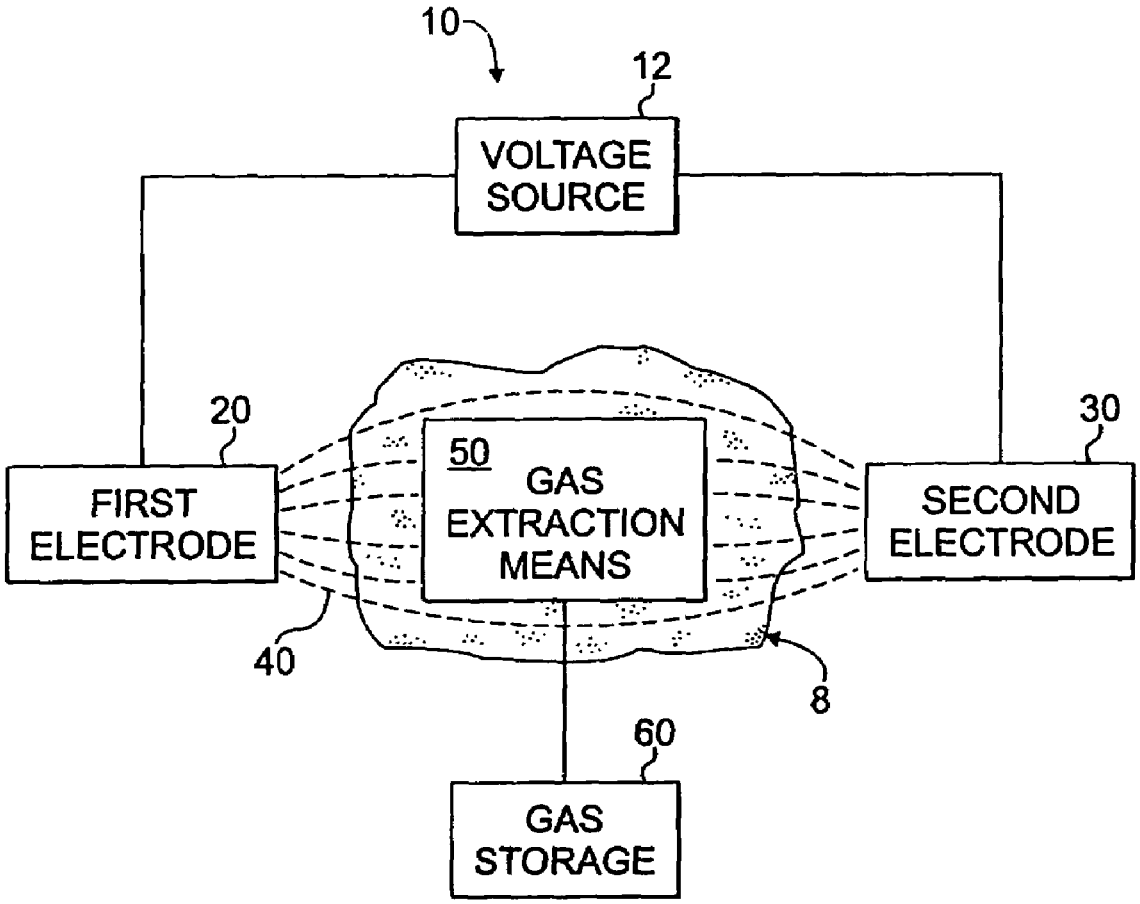
FIG. 1 is a schematic of a system for producing gas from a gas hydrate formation in accordance with the present invention.

Referring to the drawing figures in general, and to FIG. 1 specifically, a system 10 for producing gas from a formation containing gas hydrates is shown in schematic form in accordance with the present invention. The system 10 is installed in the vicinity of a gas hydrate formation 8. Two or more electrodes, such as a first electrode 20 and a second electrode 30, are placed in or around the gas hydrate formation 8 and connected with a voltage source 12. Electric current is applied between the electrodes 20, 30 and across the gas hydrate formation 8 to produce an electric field 40 across the hydrate formation. The electric field 40 is applied to the formation to release gas from the gas hydrates. The release of gas from the gas hydrates is primarily carried out through resistive heating. The electric field 40 gradually produces heat in the formation 8 based on electrical resistivity of the sediments and materials in the formation 8. As heat is generated, the temperature around the gas hydrates increases until the hydrates are destabilized, releasing the gas from the hydrate molecules. A gas extraction means 50 is placed within the hydrate formation 8 to capture and convey the released gas to a gas collection system 60.

The system 10 may be used in a variety of applications to produce gas from gas hydrate deposits. For purposes of this description, the system 10 will be shown and described in the context of methane gas production, with the understanding that the invention can be applied to a variety of different gas hydrate formations containing varying amounts of methane and other gases. The present invention is operable in different formations of varying compositions, and may be used for releasing and collecting gases other than methane gas. In addition, while this description refers to methane gas, it is understood that the gas released from a formation will likely contain a mixture of methane gas and other gases.

The present invention can be practiced using a multiplicity of electrodes placed in vertical, horizontal or angular orientations and configurations. The arrangement of components in a given installation will vary depending on the location and local geology of the hydrate formation. As stated earlier, methane hydrate formations have been studied in arctic permafrost regions as well as in sediment layers on or beneath the ocean floor. Hydrate formations may exist as large relatively flat homogeneous formations, or may be interrupted by outcrops of non-hydrate material. Therefore, the electrodes may be positioned in a number of arrangements in or around the formation.

Figure 2:
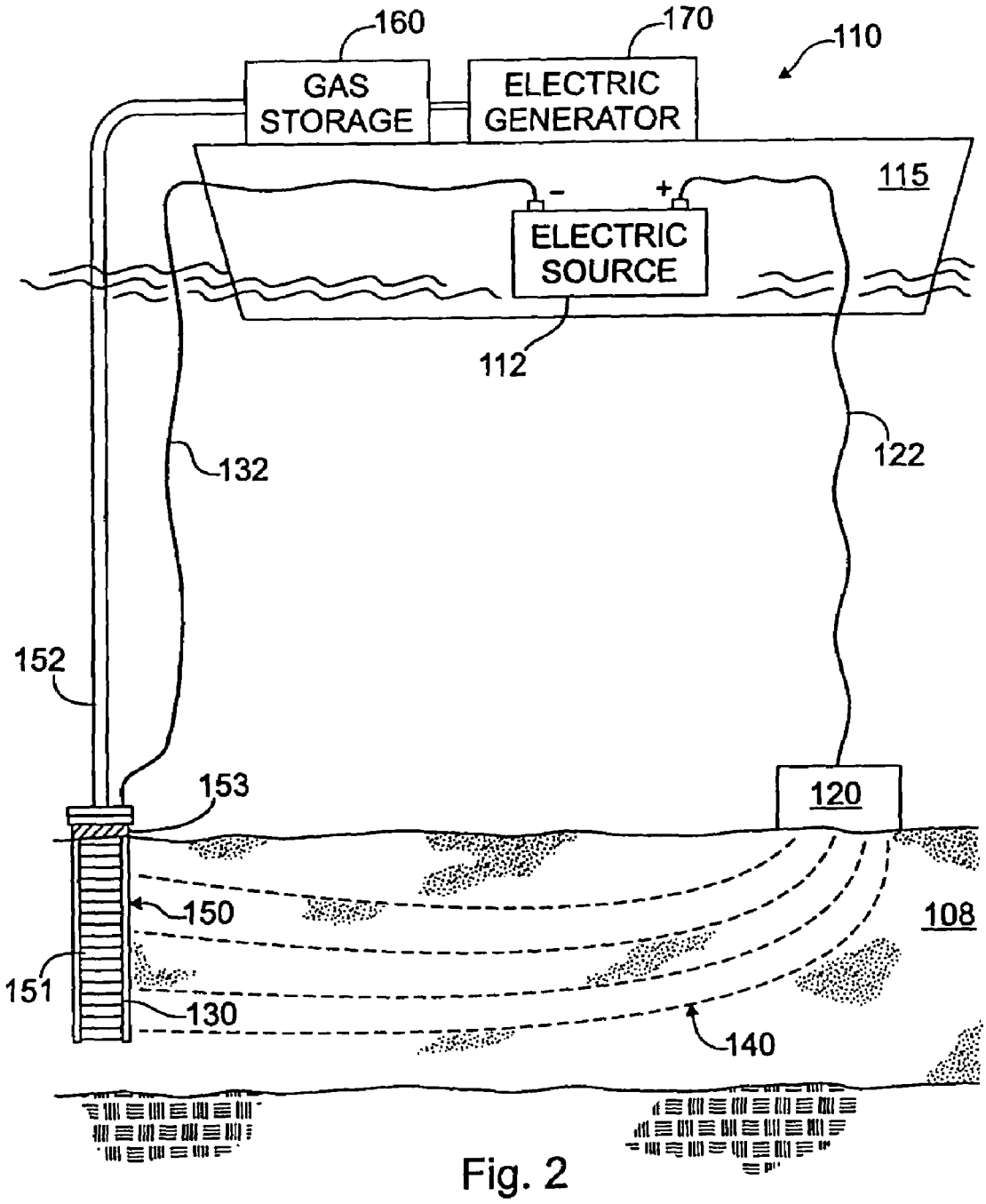
FIG. 2 is a schematic of a system for producing gas from a gas hydrate formation in accordance with the present invention, where the system is employed on an ocean vessel to extract gas from a gas hydrate formation on the ocean floor.

Referring now to FIG. 2, a system 110 in accordance with one embodiment of the present invention is operable to produce methane gas from a methane hydrate formation 108 along the sea floor. The system 110 includes a high-voltage electric power source 112 supported above the formation. The components of system 110 may be located on land or supported on a ship, rig, barge, vessel, or other means in proximity to the formation. In FIG. 2, the system is shown on a barge 115. By means of an insulated cable 122, the relatively positive terminal, or anode, of the power source 112 is connected to a first electrode 120. Depending on the geology of the sea floor, and the proximity of the methane hydrate formation to the sea floor surface, the first electrode 120 may be suspended above the sea floor, rest on the sea floor or be installed beneath the sea floor through a fissure, crevice or bore hole that penetrates beneath the sea floor in proximity to the hydrate formation. For purposes of FIG. 2, it will be assumed that a significant volume of stabilized methane hydrate is exposed on the sea floor in a substantially flat layer, allowing the first electrode 120 to rest on the sea floor.

A gas collection well 150 is drilled into the formation 108 to recover methane gas released from the formation during operation of the system 110. The collection well 150 includes a perforated metallic liner 151 which extends down into the formation 108. The perforated liner 151 has one or more perforations that connect the interior of the collection well 150 in fluid communication with the interior of the formation 108. Since the hydrate formation 108 is exposed on the sea floor, the liner 151 extends from the top of the well 150 into the formation. In hydrate formations that are buried under a layer of overburden material, the well 150 may include a solid casing that extends through the overburden. The specific construction of the well is not germane to the invention, and will largely depend on the geologic conditions around the hydrate formation. Preferably, the collection well 150 is completed in accordance with conventional undersea drilling practices.

The relatively negative terminal on the power source 112, or cathode, is connected to a second electrode 130 placed within the methane hydrate formation 108. The second electrode 130 may have several forms and be positioned in the formation in several ways. For example, the second electrode could be lowered through large cracks or fissures in the formation. In the preferred embodiment, the second electrode 130 is associated with the gas collection well 150. The second electrode 130 may be a separate component installed inside the collection well 150 or in the proximity of the collection well. Alternatively, the second electrode 130 may be part of the collection well 150 itself. In the embodiment shown in FIG. 2, the perforated metallic liner 151 serves as the second electrode 130. An insulated cable 132 connects the liner 151 with the relatively negative terminal on the power source 112. The top portion of the well 150 forms an electro-conductive path between the insulated cable 132 and the second electrode 130. In this arrangement, an electric field 140 is generated through the formation 108 when a voltage drop is created across the electrodes 120, 130. The gas collection well 150 may be installed to depths of 500 meters or greater to reach the hydrate formation.

Thus far, the first electrode 120 above the formation has been shown connected to the relatively positive terminal, or anode, of the power source 112, and the second electrode 130 within the formation has been shown connected to the relatively negative terminal, or cathode, of the power source. There is nothing that precludes the first electrode 120 from being connected to the cathode of the power source 112, and nothing to preclude the second electrode 130 from being connected to the anode of the power source, however. Therefore, the electrode in the formation may be connected with either terminal of the voltage source 112.

The electrical resistance of the sediment in the formation is sufficiently low to allow the passage of current through the formation between the first and second electrodes 120, 130. Although the resistivity of the formation 108 is substantially higher than that of the seawater above the electrodes, the current passes directly through the formation because this path is much shorter than any path through the overlying seawater to "ground." In the preferred embodiment, the second electrode 130 is connected with an insulating break 153 that substantially prevents short circuiting of current up through the well casing.

To create the electric field 140 and commence resistive heating in the formation, a voltage drop is produced across the electrodes 120, 130. The voltage may be a straight DC voltage or a DC-biased signal with a ripple component produced under modulated AC power. Alternatively, the periodic voltage may be established using pulsed DC power. The voltage may be produced using any technology known in the electrical art. For example, voltage from an AC power supply may be converted to DC using a diode rectifier. The ripple component may be produced using an RC circuit.

The choice of AC power or DC power depends on many variables, and each option has advantages. One advantage of AC is that AC systems have less potential for corrosion on the electrode than DC. The use of AC also has limitations, including a limited effectiveness at deeper depths. Losses in steel well casings dissipate energy. This dissipation increases with depth, and will typically limit the use of AC to depths of approximately 5,000 feet below the top of the well. Use of AC can be applied at greater depths, but resistive heating may be very limited. Therefore, for well casings and liners extending greater than 5,000 feet, straight DC power is preferable. AC power is desirable in shallower well installations, where losses are less of a factor.

Where DC power is used to induce destabilization of methane hydrates, the process of producing and recovering methane gas may be enhanced through electro-osmosis and ion migration. In addition, electrochemical reactions such as the production of oxygen and hydrogen may assist in the production of methane. Electrochemical reactions can also create methanol and ethane through oxidation and reduction. The electric potential required for carrying out thermal destabilization of methane hydrates will vary depending on pressure and temperature conditions at the formation, and the size of the desired electric field.

Figure 3:
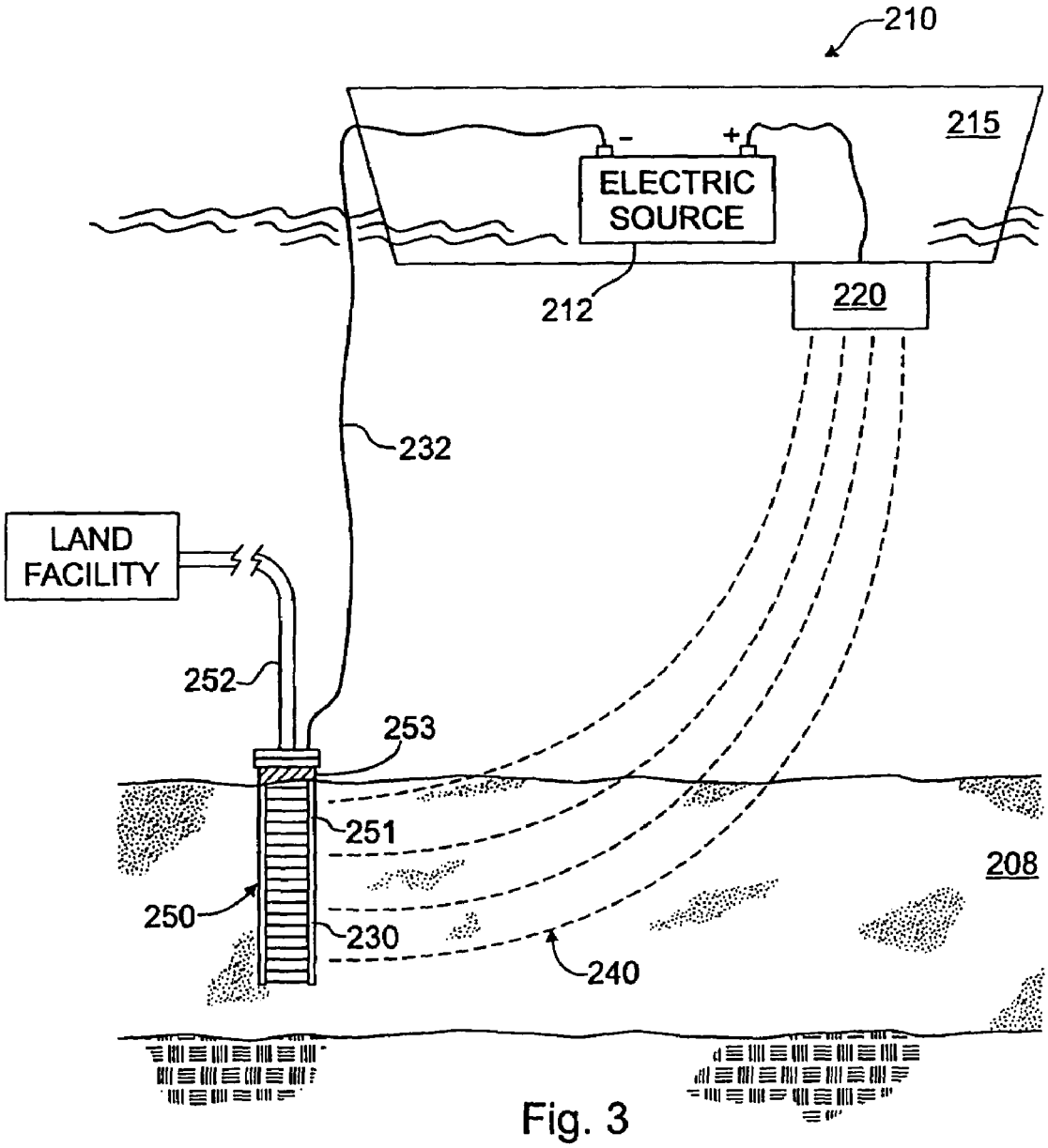
FIG. 3 is a schematic of an alternate system for producing gas from a gas hydrate formation in accordance with the present invention, where the system is employed on an ocean vessel to extract gas from a gas hydrate formation on the ocean floor.

Referring now to FIG. 3, a system 210 in accordance with the present invention includes a high-voltage electric power source 212 located on a barge 215, and a first electrode 220 incorporated into the structure of the barge. The first electrode 220 is connected to a relatively positive terminal, or anode, of the power source 212. A gas collection well 250 is drilled into a methane hydrate formation 208, similar to the embodiment described above. The collection well 250 includes a perforated metallic liner 251 which extends down into the formation 208 and serves as a second electrode 230. An insulated cable 232 connects the liner 251 with the relatively negative terminal on the power source 212.

Based on the foregoing, persons skilled in the art will understand the advantages of system 210 over prior methods for producing gas from gas hydrates. The first electrode 220 is integrally connected with the barge 215, while the second electrode 230 is a stationary electrode. The position of the first electrode can be adjusted by navigating the barge in different positions relative to the second electrode 230. By moving the first electrode, the position and intensity of the electric field can be modified. The ability to move electrodes maximizes the range of application of the electric field. Theoretically, the position of the field can be adjusted through an angle of up to 360 degrees around a single stationary electrode. The same benefits may be achieved on land by mounting electrodes on vehicles. For example, it is anticipated that the present invention may be applied in arctic permafrost regions, with electrodes mounted on heavy track machines or all-terrain vehicles. The ability to reposition the electric field greatly reduces the number of bore holes and electrodes that must be installed, since an electric field can be applied over a relatively large area by maneuvering a small number of electrodes around the formation.

Gas may be captured or collected using a variety of piping arrangements in accordance with the present invention. In FIG. 2, the well 150 is connected to a riser pipe or conduit 152 which connects to a storage tank 160 on the barge 115. In this arrangement, gas can be collected on the barge and transported to shore. The conduit 152 may require special reinforcements or materials suitable for withstanding pressures and currents associated with deep sea installations. These structural reinforcements and materials are generally known and therefore will not be described in detail herein. In addition to storing the gas on the barge 115, the gas may be used to fuel an electric generator 170 installed on the barge. In this type of system, gas may be piped from the extraction well into a storage tank on the barge, and subsequently fed to a boiler to generate steam. Electricity generated on the barge may then be exported to the mainland by undersea cables. The gas may also be piped from the extraction well directly to land. In FIG. 3, the well 250 is connected to undersea piping 252 which transports the gas to a bulk storage plant, power generator, or other facility located on land.

The terms and expressions which have been employed herein are used as terms of description and not of limitation. There is no intention in the use of such terms and expressions of excluding any equivalents of the features shown and described or portions thereof. It is recognized, therefore, that various modifications are possible within the scope and spirit of the invention. Accordingly, the invention incorporates variations that fall within the scope of the following claims.

We claim:

1. A method for extracting gas from underground formations containing gas hydrates, said method comprising the steps of:

A. placing two or more electrodes in proximity of said formation;

B. drilling an extraction well into said formation, said extraction well having one or more perforations to provide fluid communication between the interior of the well and the formation;

C. connecting a source of voltage to said two or more electrodes;

D. applying a d-c biased signal with a ripple component between said two or more electrodes to produce an electrical current and establish an electric field through said formation;

E. adjusting the current through said formation to thermally react with the gas hydrates in the formation and release gases from the gas hydrates; and F. drawing the released gases through the perforations into the extraction well.

2. The method of claim 1, wherein the gases comprise methane gas and the gas hydrates comprise methane hydrates.

3. The method of claim 1, comprising the step of drawing the gases out of the extraction well to a storage area.

4. The method of claim 1, comprising the step of conveying the gases from the extraction well to a power generator.

5. The method of claim 1, comprising the step of moving one of said electrodes to change the position of the electric field relative to the formation.

6. A system for producing power from gas hydrates contained in a hydrate formation under an ocean floor, said gas hydrate formation having a first region and a second region, said system comprising:

A. a gas extraction system, comprising:

(1) a first electrode disposed in proximity to said first region of the formation;

(2) a second electrode disposed in proximity to said second region of the formation, said second electrode being separated from said first electrode by an electro-conductive path through said formation;

(3) an extraction well extending into the ocean floor in proximity to said electro-conductive path, said well comprising one or more perforations in fluid communication with said formation; and (4) a voltage source connected to said first and second electrodes, said voltage source being operable to produce a voltage difference across said first and second electrodes;

B. an electric power generator in operable connection with said extraction well, said generator being operable to convert gases collected from the extraction well into electric power; and C. a housing for said power generator, said housing comprising a floating vessel having a bottom side generally located above the formation.

7. The system for producing power of claim 6, wherein the second electrode is integrally mounted no the bottom side of the vessel.

8. The system for producing power of claim 6, wherein the second electrode is positioned on the ocean floor.

9. A system for producing methane gas contained in a methane hydrate formation on an ocean floor, said hydrate formation having a first region and a second region, said system comprising:

A. a first electrode disposed in proximity to said first region of the formation;

B. a second electrode disposed in proximity to said second region of the formation, said second electrode being separated from said first electrode by an electro-conductive path through said formation;

C. an extraction well extending into the ocean floor and within said formation in proximity to said electro-conductive path, said well comprising one or more perforations in fluid communication with said formation; and D. an ocean vessel positioned above said formation, said ocean vessel housing a voltage source connected to said first and second electrodes, said voltage source being operable to produce a voltage difference across said first and second electrodes.

10. The system for producing methane gas of claim 9 comprising a gas storage tank on the ocean vessel in fluid connection with said extraction well.

11. The system for producing methane gas of claim 9 comprising an electric generator on said ocean vessel in operable communication with said extraction well, said generation being fueled by methane gas derived from said extraction well.

12. The system for producing methane gas of claim 9 comprising an undersea pipeline connected between said extraction well and a gas recovery facility on land.

13. On an movable vehicle or vessel positioned above a formation comprising methane hydrates, a system for producing methane gas, comprising:

A. a stationary electrode disposed in proximity to a first region of the methane hydrate formation;

B. a non-stationary electrode disposed in proximity to a second region of the methane hydrate formation, said non-stationary electrode being movable relative to said stationary electrode and separated from said stationary electrode by an electro-conductive path through said formation; and C. an extraction well extending into the formation in proximity to said electro-conductive path, said extraction well comprising one or more perforations in fluid communication with said formation.

14. The system for producing methane gas of claim 13, wherein the formation is located on the ocean floor, and the second electrode is integrally mounted on a bottom side of a barge positioned in proximity to said formation, the position of said second electrode being controlled by the navigational position of the barge.

* * * * *